US009827650B2

(12) United States Patent
Santure

(10) Patent No.: US 9,827,650 B2
(45) Date of Patent: Nov. 28, 2017

(54) SURFACE MEDIA BLASTER

(71) Applicant: Robert J Santure, Saline, MI (US)

(72) Inventor: Robert J Santure, Saline, MI (US)

( * ) Notice: Subject to any disclaimer, the term of this patent is extended or adjusted under 35 U.S.C. 154(b) by 0 days.

(21) Appl. No.: 15/350,331

(22) Filed: Nov. 14, 2016

(65) Prior Publication Data

US 2017/0057053 A1 Mar. 2, 2017

Related U.S. Application Data

(60) Continuation-in-part of application No. 14/542,969, filed on Nov. 17, 2014, now Pat. No. 9,492,907, which is a division of application No. 13/507,374, filed on Jun. 22, 2012, now Pat. No. 8,894,467.

(60) Provisional application No. 61/571,228, filed on Jun. 23, 2011.

(51) Int. Cl.

| | |
|---|---|
| ***B24C 3/04*** | (2006.01) |
| ***B24C 3/06*** | (2006.01) |
| ***B24C 5/00*** | (2006.01) |
| ***B24C 3/32*** | (2006.01) |
| ***B24C 9/00*** | (2006.01) |

(52) U.S. Cl.

CPC ..... *B24C 3/06* (2013.01); *B24C 3/04* (2013.01); *B24C 3/325* (2013.01); *B24C 5/005* (2013.01); *B24C 9/00* (2013.01)

(58) Field of Classification Search

CPC .. B24C 3/06; B24C 3/04; B24C 3/325; B24C 5/005; B24C 9/00; B08B 9/093

USPC ..... 451/102, 86

See application file for complete search history.

(56) References Cited

U.S. PATENT DOCUMENTS

| | | | | |
|---|---|---|---|---|
| 1,345,834 | A * | 7/1920 | Chandler | B05C 1/022 118/207 |
| 2,728,689 | A * | 12/1955 | Ransburg | B05B 5/08 118/626 |
| 3,149,438 | A * | 9/1964 | Morley | B66F 9/127 248/81 |
| 3,396,492 | A * | 8/1968 | Schenck | B24C 3/062 118/305 |
| 3,548,541 | A * | 12/1970 | Miller | B63C 5/02 451/75 |

(Continued)

FOREIGN PATENT DOCUMENTS

| | | | | |
|---|---|---|---|---|
| GR | WO 9748527 | A1 * | 12/1997 | B08B 3/024 |
| WO | WO 9314905 | A1 * | 8/1993 | B23Q 11/0866 |

*Primary Examiner* — George Nguyen

(74) *Attorney, Agent, or Firm* — Gerald R. Black, Esq.

(57) ABSTRACT

An apparatus for blasting a media onto a surface comprises an oscillating nozzle, a mount and a power source. The mount attaches the nozzle to tooling, enabling the nozzle to be raised and lowered about a vertical axis, and enabling the nozzle to be repositioned about a horizontal axis. The power source enables the nozzle to oscillate. The blasting media is sprayed through the nozzle onto the surface. The oscillating nozzle projects an enlarged dispersion pattern of the blasting media onto the surface being treated. The apparatus may include a basket positioned near the mount, enabling an operator to be positioned upon a truss and control the blasting of the media onto the surface, the basket being mounted via a swivel bearing, enabling the basket to self-level. Also, the media blasting apparatus may be controlled by an operator positioned in a remote control computer area.

18 Claims, 9 Drawing Sheets

(56) References Cited

U.S. PATENT DOCUMENTS 3,566,543 A * 3/1971 Fogle ..... B24C 3/065 451/2
3,863,393 A * 2/1975 Goff ..... B24C 3/062 114/222
4,055,139 A * 10/1977 Scheiding ..... B63B 27/146 114/382
4,139,970 A * 2/1979 Hockett ..... B24C 3/00 239/588
4,199,905 A * 4/1980 Neidigh ..... B08B 9/08 180/901
4,286,417 A * 9/1981 Shelton ..... B24C 3/062 451/2
4,408,419 A * 10/1983 Appling ..... B24C 3/06 105/153
4,445,451 A * 5/1984 van den Broek ..... B63C 5/02 114/222
4,545,156 A * 10/1985 Hockett ..... B24C 3/06 118/323
4,708,214 A * 11/1987 Krawza ..... B24C 1/045 175/424
4,825,598 A * 5/1989 Schlick ..... B24C 3/065 451/132
4,941,295 A * 7/1990 Carpenter ..... B24C 9/00 406/100
4,979,338 A * 12/1990 Schmitz, II ..... B24C 3/263 451/86
5,098,021 A * 3/1992 Kah, Jr. ..... B05B 3/0431 239/231
5,138,800 A * 8/1992 Janusz ..... B23Q 1/48 451/11
5,240,503 A * 8/1993 Levy ..... A47L 1/02 118/323
5,291,695 A * 3/1994 Healy ..... B24C 3/065 451/89
5,309,683 A * 5/1994 Hockett ..... B23Q 11/0866 451/102
5,339,573 A * 8/1994 Uchida ..... B23K 31/12 451/75
5,367,841 A * 11/1994 Smith ..... B24C 3/062 451/87
5,385,609 A * 1/1995 Rose ..... B24C 3/32 118/119
5,398,632 A * 3/1995 Goldbach ..... B63B 59/06 114/222
5,419,734 A * 5/1995 Van Sickle ..... B24C 9/00 239/587.1
5,456,629 A * 10/1995 Bingham ..... B24C 1/003 451/102
5,520,734 A * 5/1996 Taylor ..... B05B 13/0214 118/307
5,540,172 A * 7/1996 Goldbach ..... B63C 5/00 114/222
5,685,767 A * 11/1997 Burds ..... B24C 3/06 451/439
5,730,646 A * 3/1998 Watkin ..... B63B 59/06 451/2
5,765,578 A * 6/1998 Brandt ..... B08B 7/0021 134/37
5,807,168 A * 9/1998 Goldbach ..... B05B 13/005 118/313
5,901,720 A * 5/1999 Lange ..... A47L 1/02 118/307
5,964,645 A * 10/1999 Jemt ..... B24B 7/182 451/354
6,070,371 A * 6/2000 Myrick ..... E04G 21/28 160/352
6,102,157 A * 8/2000 Goldbach ..... B05B 13/005 182/128
6,186,273 B1 * 2/2001 Goldbach ..... B05B 13/005 182/128
6,328,813 B1 * 12/2001 Dornier ..... A47L 1/02 134/172
6,402,587 B1 * 6/2002 Nopwaskey ..... B24C 1/045 451/2
6,419,566 B1 * 7/2002 Palmisano ..... B24C 1/003 451/102
6,461,231 B1 * 10/2002 Taylor ..... B08B 9/023 451/88
6,543,462 B1 * 4/2003 Lewis ..... B08B 3/02 134/144
6,675,548 B2 * 1/2004 Bristol ..... B24C 1/06 239/11
6,705,921 B1 * 3/2004 Shepherd ..... B24C 1/045 408/180
6,749,490 B1 * 6/2004 Hafenrichter ..... B24C 1/045 451/2
7,311,162 B2 * 12/2007 Jeswine ..... B62D 49/0621 180/164
7,316,604 B1 * 1/2008 Burks ..... B24B 19/26 451/354
7,455,570 B2 * 11/2008 Yanaka ..... B24C 1/08 451/38
7,766,725 B2 * 8/2010 Umemura ..... B24C 3/04 451/85
7,966,856 B1 * 6/2011 Razi ..... B21J 15/02 29/90.7
8,464,804 B2 * 6/2013 Beaudry ..... B23Q 1/012 173/1
8,540,552 B2 * 9/2013 Reukers ..... B24C 1/045 451/102
2004/0132383 A1 * 7/2004 Langford ..... B24C 1/045 451/38
2004/0185757 A1 * 9/2004 Nakayama ..... B24C 3/14 451/86
2005/0077775 A1 * 4/2005 Nakakuro ..... E21D 9/115 299/17
2007/0042676 A1 * 2/2007 Shimizu ..... B24C 3/065 451/5
2008/0235928 A1 * 10/2008 Mars ..... B24C 1/086 29/81.06
2008/0287039 A1 * 11/2008 Connelly ..... B24C 3/06 451/38
2010/0093261 A1 * 4/2010 Seyffert ..... A62C 31/22 451/38
2010/0178849 A1 * 7/2010 Gobbi ..... A47L 11/02 451/41
2012/0067184 A1 * 3/2012 Hach ..... B26F 3/00 83/177
2012/0135670 A1 * 5/2012 Baer ..... B24C 9/00 451/102
2013/0043094 A1 * 2/2013 Lee ..... E04G 3/243 182/113
2013/0196574 A1 * 8/2013 Santure ..... B24C 3/04 451/38

* cited by examiner

SURFACE MEDIA BLASTER

CROSS-REFERENCE TO RELATED APPLICATIONS

This application is related to and is a Continuation-In-Part Application to U.S. Ser. No. 14/542,969, entitled "Surface Media Blasting System and Method", by Robert J. Santure filed on Nov. 17, 2014, which is a divisional of U.S. Pat. No. 8,894,467, entitled "Surface Media Blasting System and Method", by Robert J. Santure filed on Jun. 22, 2012, and is related to and claims priority to U.S. Provisional Application No. 61/571,228, entitled "Interior Surface Media Blaster", by Robert J. Santure, filed on Jun. 23, 2011.

FIELD OF USE

The present invention relates to a device enabling a more efficient method of cleaning of either interior and exterior surfaces that require periodic cleaning, painting, and contaminant removal and maintenance, such as large storage tanks, and particularly, water towers, and more particularly, an oscillating media blasting nozzle which enlarges the media blasting path.

BACKGROUND OF THE INVENTION

Prior approaches to obtain a larger work path while media blasting a surface use single narrow angle nozzles, two nozzles or multiple nozzles which are attached at fixed angles.

U.S. Patent Document No. 20120135670 (Baer) discloses a means of increasing the productivity and improving the safety of an internal diameter cylindrical blast cleaning, the introduction of an attachment apparatus makes it possible to eliminate or dramatically reduce the use of personnel inside a blast chamber while the process is ongoing thus improving safety of the process and improving the productivity and uniformity of the blasting process. The apparatus includes three principal elements: a blast chamber in which a cylindrical product to be to be treated is mounted on a device that rotates the cylindrical product to be treated; one or more blasting systems and one or more blasting operators.

U.S. Pat. No. 7,163,449 (Davis) discloses a hand held abrasive blaster includes a tubular wand housing and an abrasives conduit which extends into the wand housing. The abrasives conduit includes a fixed portion at the rearward end and a rotatable portion at the forward end. A motor rotates the rotatable portion with handles positioned along the exterior of the wand housing at a center of gravity of the wand housing.

U.S. Pat. No. 2,755,598 (Denburgh) discloses an abrasive blast cleaning system using jet nozzles. One of the most efficient manners of cleaning all sorts of articles or surfaces, both small and large, is by means of abrasive blasting or, more descriptively, by the use of compressed air to direct a jet of abrasive particles, such as sand or steel grit, against the particular surface to be cleaned. In the development of this art many different types of nozzles have been suggested in an effort to produce a blast which will clean the surface in the most expeditious manner and, as might be expected, different nozzles are to be preferred depending upon the particular type of work at hand, as well as the particular material used as a cleaning agent.

Accordingly, what is needed is to decrease water tower downtime, thus reducing the cost to the municipality in having to rent special equipment to maintain water pressure while work is being performed, wherein an operator can apply media blasting material to larger surface areas requiring fewer passes.

Also, surface media blasting poses a danger to the operator(s) and any and all safety precautions must be taken to improve the safety conditions.

The object of the present invention is to reduce costs, and time savings to the operator as less time is required to perform the same amount of work, as fewer passes are needed to blast the same amount of surface area.

SUMMARY OF THE INVENTION

The oscillating interior and exterior surface media blaster of the present invention addresses these needs.

An apparatus for blasting a media onto a surface comprises an oscillating nozzle, a mount and a power source. The mount attaches the nozzle to tooling, enabling the nozzle to be raised and lowered about a vertical axis, and enabling the nozzle to be repositioned about a horizontal axis. The power source enables the nozzle to oscillate. The blasting media is sprayed through the nozzle onto the surface. The oscillating nozzle projects an enlarged dispersion pattern of the blasting media onto the surface being treated. The apparatus may include a basket positioned near the mount, enabling an operator to be positioned upon a truss and control the blasting of the media onto the surface, the basket being mounted via a swivel bearing, enabling the basket to self-level. Also, the media blasting apparatus may be controlled by an operator positioned in a remote control computer area.

The oscillating interior and exterior surface media blaster of the present invention preferably uses aluminum construction which helps to make the apparatus lighter and easier to use when mounted on a robot or blasting gantry by putting less stress on the robot or gantry, reducing wear and tear on equipment. Also, the oscillating interior and exterior surface media blaster of the present invention does not have the media going through the operating mechanism of the gun, greatly reducing wear and tear on the electric motor and associated elements.

By having the head of the blasing gun oscillating during use, a larger pattern is achieved, which reduces the amount of time spent working on a given section. There are also fewer moving parts by minimizing the number of nozzles deployed, as opposed to using numerous nozzles as is common in the industry.

The oscillating interior and exterior surface media blaster of the present invention is mounted to a variable length truss which is remotely controlled from outside, or inside the water tower or other building being media blasted.

For a complete understanding of the present invention, reference is made to the accompanying drawings and description in which the presently preferred embodiments of the invention are shown by way of example. As the invention may be embodied in many forms without departing from spirit of essential characteristics thereof, it is expressly understood that the drawings are for purposes of illustration and description only, and are not intended as a definition of the limits of the invention.

DETAILED DESCRIPTION OF THE PREFERRED EMBODIMENTS

Figure 1:
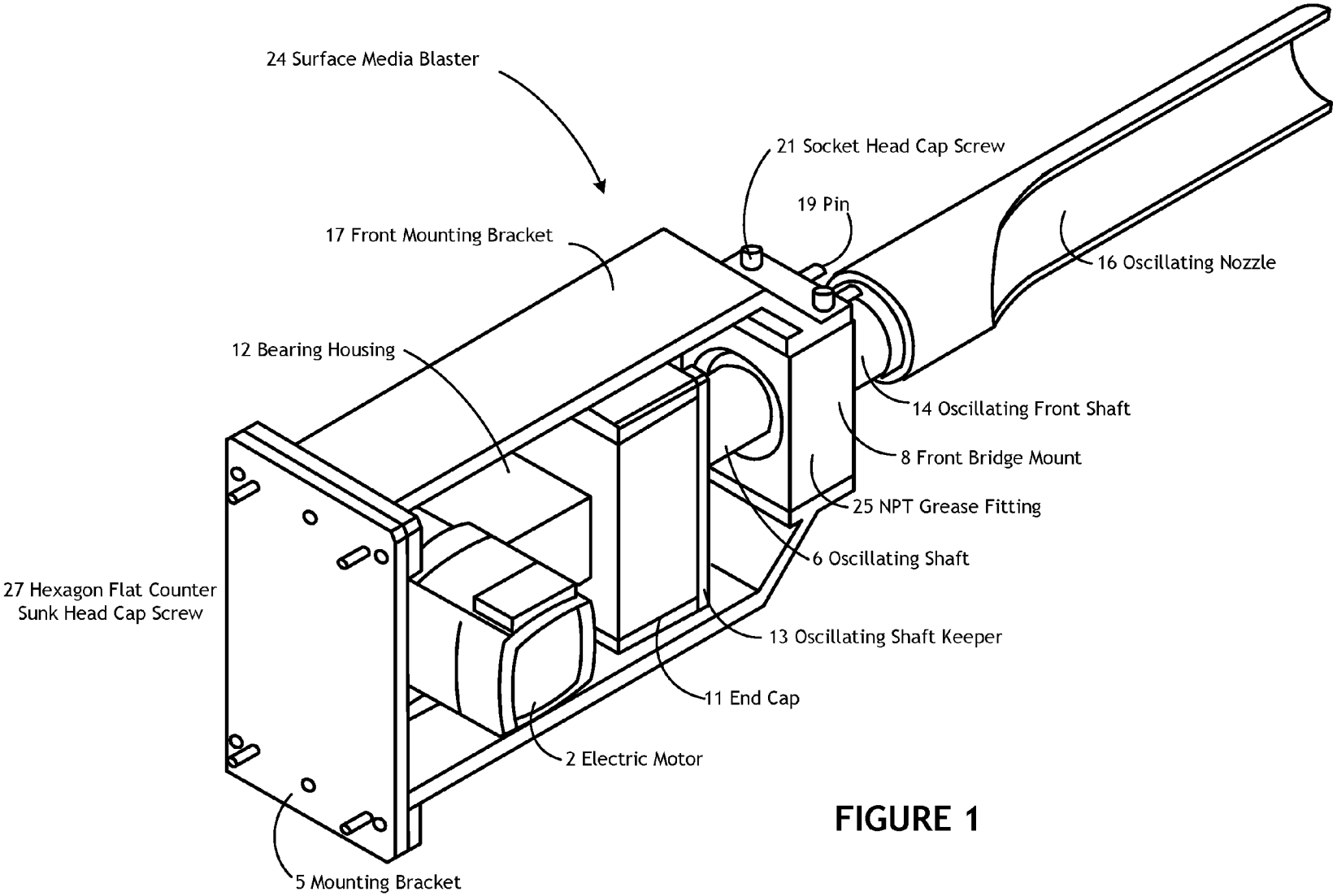
FIG. 1 depicts an assembly view of a first preferred embodiment of the surface media blaster of the present invention.

FIG. 1 is an isometric depiction of the assembled oscillating interior and exterior surface media blaster [24] of the present invention. The present invention is capable of being mounted to any end effector which enables an operator to media blast a surface. The media to be blasted, unlike other systems, does not flow through the blast gun mechanism, but rather, is sprayed onto the shaft oscillating nozzle [16] which is rotated at high speed via the electric motor [2] or other power source, creating the large fan pattern, projecting the blast media onto the surface to cleaned. Since no media flows through the present invention, there is much less wear than in other systems and much less cleaning and little to no maintenance required as a result.

Figure 2A:
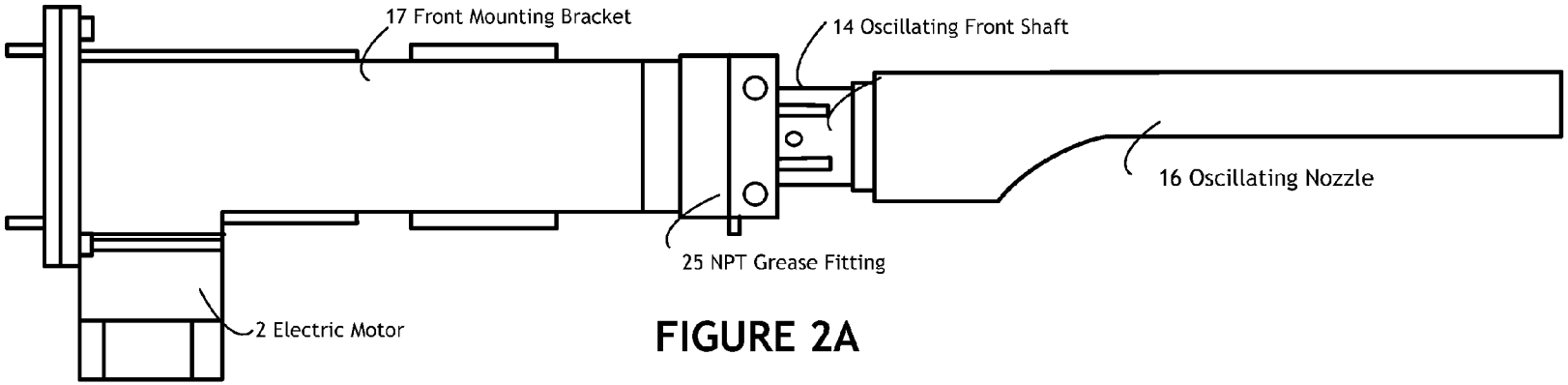
FIG. 2A depicts a top view of the surface media blaster of FIG. 1.
Figure 2B:
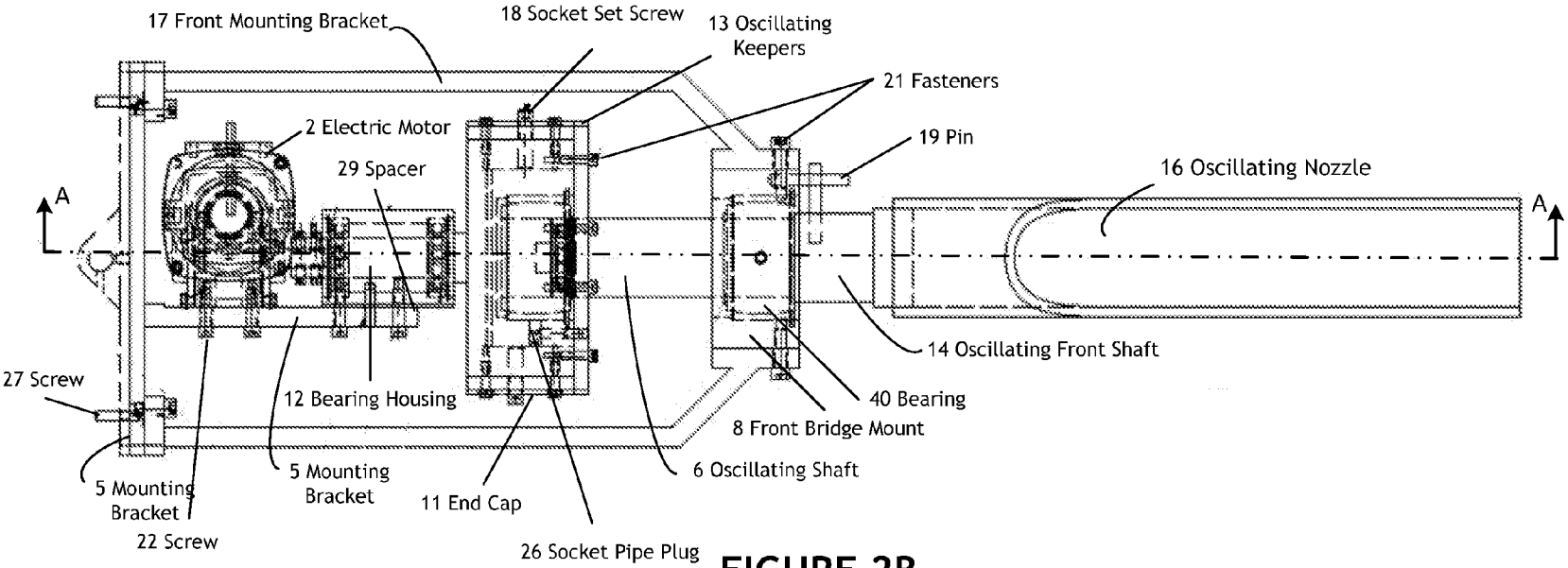
FIG. 2B depicts a side view of the interior and exterior surface media blaster of FIG. 2A.
Figure 2C:
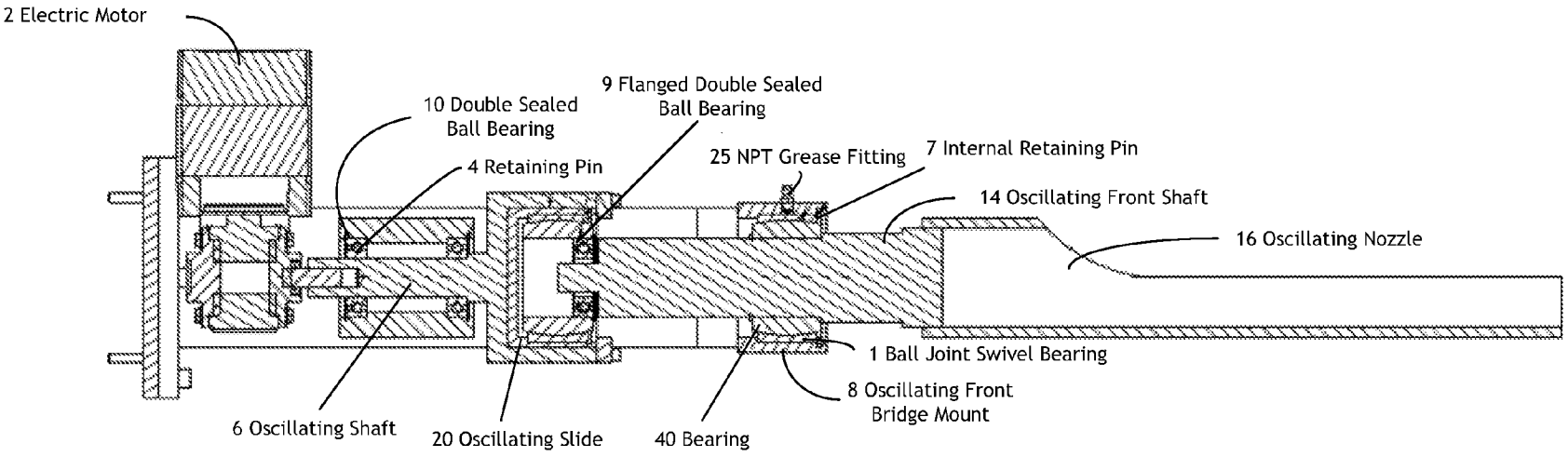
FIG. 2C depicts Section A-A taken through FIG. 2B of the surface media blaster of the present invention.

FIG. 2A depicts a side engineering view in which the assembled parts are clearly shown while FIG. 2B depicts a side cutaway view. The oscillating blast gun of the present invention comprises a mounting bracket [5] which is located at the rear of the apparatus in which a there is small shelf onto which the electric motor [2] is mounted, as well as the bearing housing [12]. Connecting the bearing housing [12] to the electric motor [2] is a small connecting shaft [35] which, in turn, is connected the oscillating shaft [6]. The oscillating shaft is connected to the front oscillating shaft [14] via the front bridge mount [8]. Inside of the front bridge mount [8] is a bearing [40] which surrounds the oscillating shaft [6]. To insure lubrication of the oscillating shaft [6] during use, there is an NPT grease fitting [25] which is screwed into the front bridge mount [8]. Connected to the front bridge mount [8] is the oscillating nozzle [16] onto which the media is sprayed. Also connected to the mounting bracket [5] is the front mounting bracket [17], of which there are two, one on the top and one on the bottom. Both are connected to the front bridge mount [8] via four socket head cap screws [21] with the rear of the front mounting brackets [17] being connected to the rear mounting bracket [5] via four hexagonal flat counter sunk head cap screws [27]. FIG. 2C depicts Section A-A taken through FIG. 2B of the surface media blaster of the present invention. From this position, the front mounting bracket [17] is shown, as well as the oscillating front shaft [14], the oscillating nozzle [16], the NPT grease fitting [25] which is attached to the front bridge mount [8]. The grease fitting [25] is needed so as to insure lubrication of the bearing [40] which is located in the oscillating front shaft [14]. At the rear is of the apparatus is visible the electric motor [2] which drives the blast gun. To attach the blast gun to the end of the variable length truss [35], four flat hexagon counter sunk head cap screws [27] are preferably used.

One primary advantage of the oscillating interior and exterior surface media blaster [24], unlike other designs, is it does not have any blasting media passing through the gun itself, so there is none of the associated wear and tear on the components as is common in other designs in which the media passes through the apparatus, wearing out bearings, motors and requiring frequent rebuilding of the blasting guns. Rather, the media is supplied to the gun via a line (see FIG. 5A) which attaches to the unit and sprays the media onto the oscillating nozzle [16] while the nozzle holder is spinning, thus creating the necessary fan width and enabling a wider path to be cleaned as opposed to current methods and apparatuses.

The improved surface media blaster and painter apparatus of the present invention [24] is able to fit into smaller spaces, while also reducing weight by eliminating the necessary electric motors necessary to move the variable length truss [35] from side to side. This also makes the unit smaller, thus enabling a fit into smaller water tanks, or other applications into which space is a premium.

Figure 3:
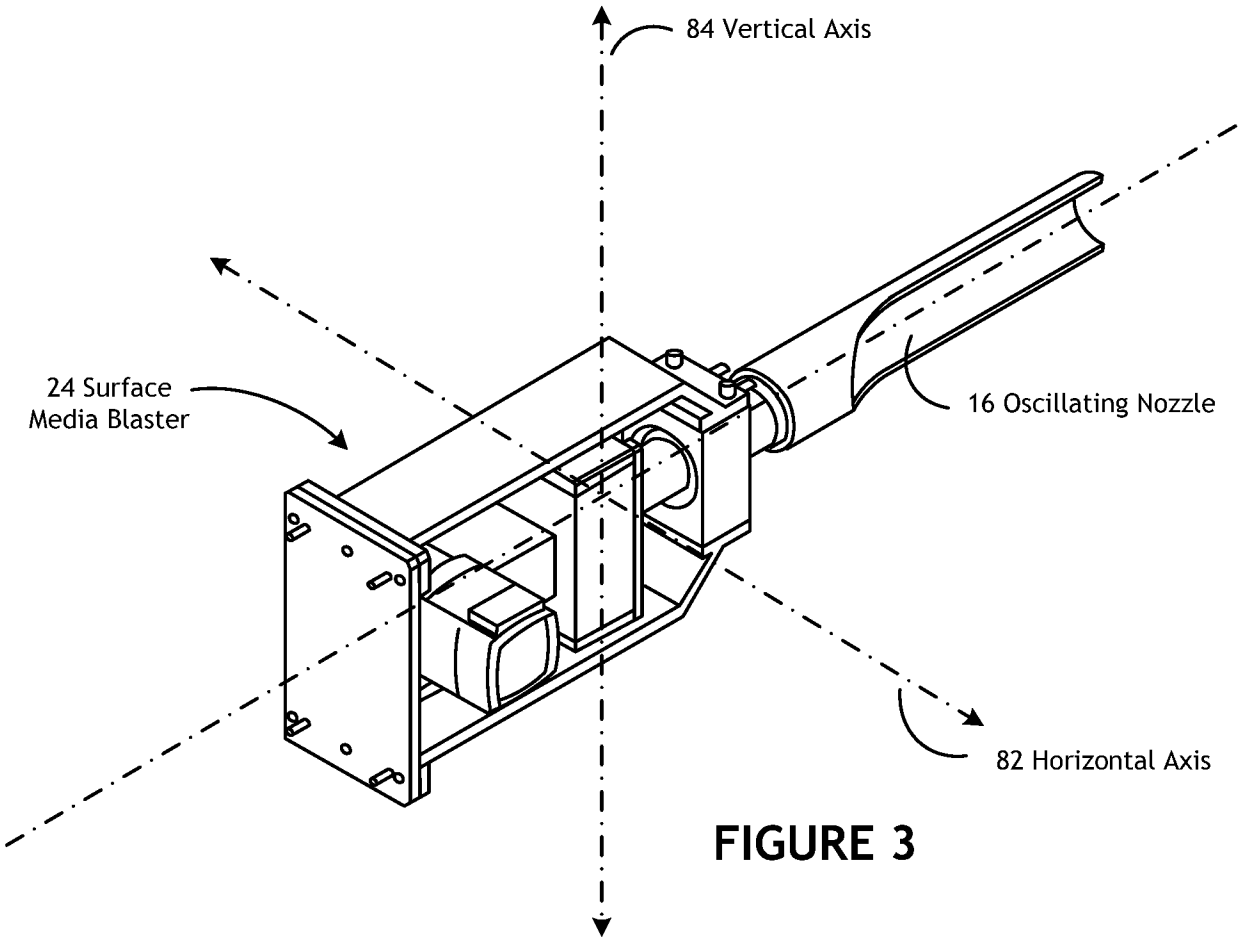
FIG. 3 depicts the surface media blaster of FIG. 1, being adjustable about a vertical axis and being adjustable about a horizontal axis.

FIG. 3 depicts the surface media blaster of FIG. 1, being adjustable about a vertical axis and being adjustable about a horizontal axis. The surface blasting apparatus of the present invention [24] comprises an oscillating nozzle [16], a mount, and a power source [2]. The mount attaches the nozzle to tooling, enabling the nozzle to be raised and lowered about a vertical axis [84]. The mount also enables the nozzle [16] to be repositioned about a horizontal axis [82]. Either a single swivel-type mount can be used to achieve movements about both axes [82 and 84], or two separate pivotal engagements may be used, one for vertical repositioning and one for horizontal repositioning. An example of a single swivel-type mount is U.S. Pat. No. 6,896,227, entitled "Universal Adjusting Mechanism for Tripods" (Ku), filed on Feb. 13, 2003.

The end of the variable length truss [35] contains another truss [40] which extends in and out; accomplished via an extension ram [38] which is mounted inside of the variable length truss [45]. The horizontal support member [32] upon which the variable length truss [35] is attached rotates vertically at its attachment points to the vertical support members [30] via two worm drive electric motors [44] so as to enable an operator to reach areas which are not located directly in front of the end of the truss [40]. On the opposing end of the variable length truss [35] can be mounted a basket [42] into which an operator can stand and control the surface blasting apparatus of the present invention [24] while inside of a water tank or building.

Figure 4:
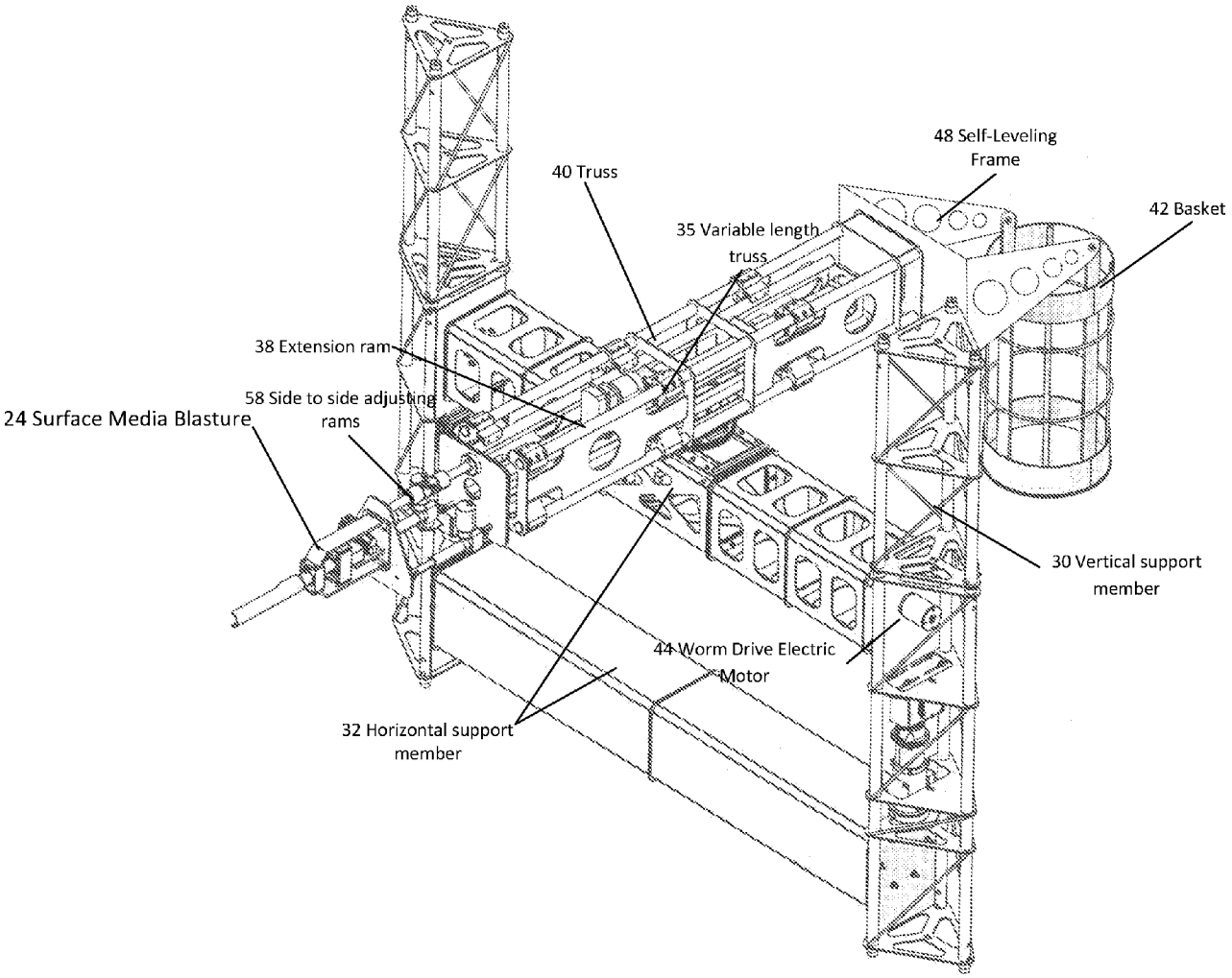
FIG. 4 depicts an assembly view of the surface media blaster as it is appears mounted onto the blasting system apparatus with a basket for an operator to be secured in while directing the surface media blasting.
Figure 5A:
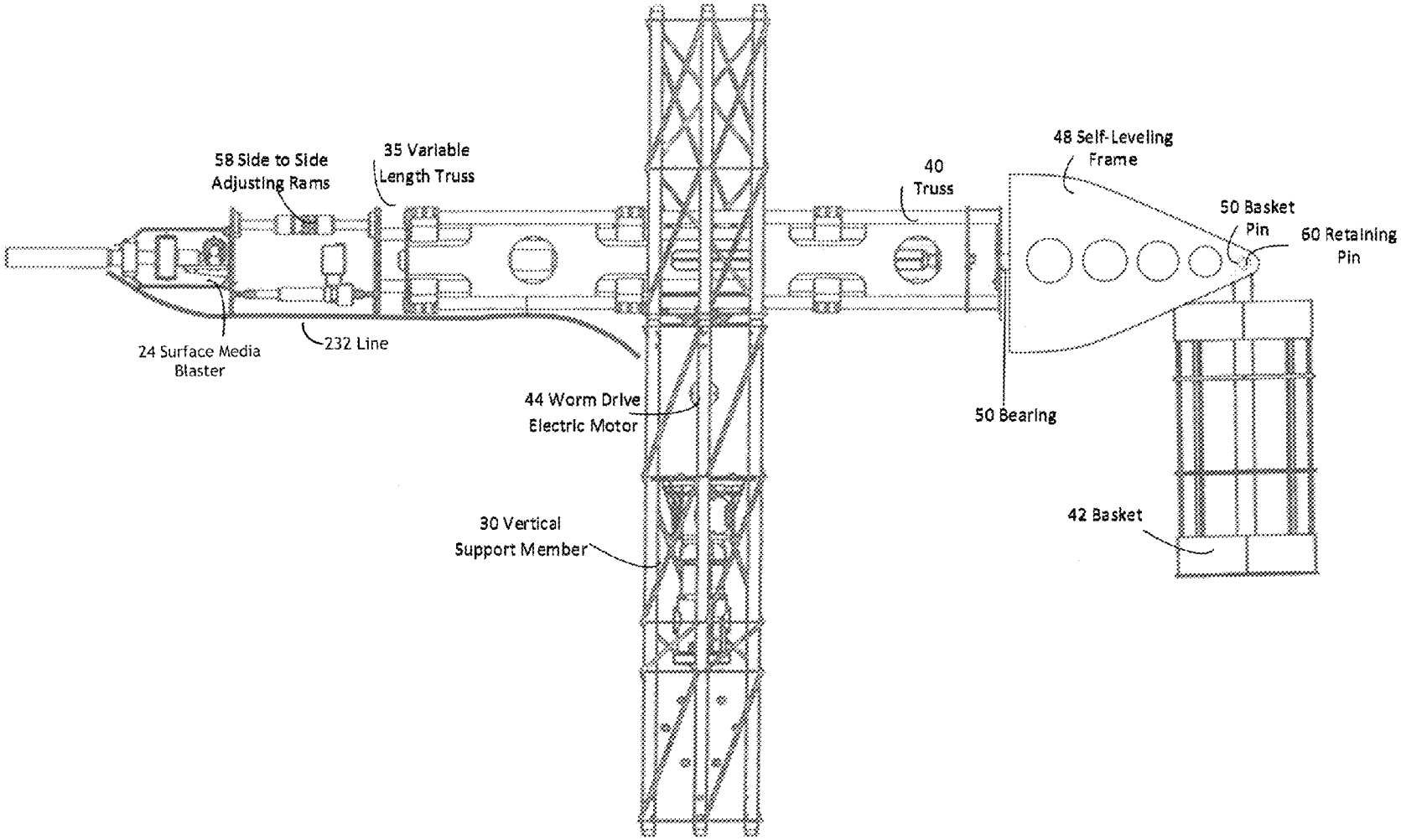
FIG. 5A depicts a side view of the surface media blaster as it is appears mounted onto the blasting system apparatus with the basket for an operator of FIG. 4.

FIG. 4 depicts an assembly view of an improved variable length truss [35] which rotates 180° while being fixed about a longitudinal axis while FIG. 5A depicts a side view of the surface media blaster [24] as it is attached to the variable length truss [35] as well as the operator basket [42] which is attached to a self-leveling frame [48]. The operator basket is attached via a pin [50] which enables the basket to be quickly removed for assembly and disassembly and transport. When the operator moves the variable length truss upward or downward, the basket self-levels via the two pins [50], one on each side, which contain bearings and enables the basket to move freely. To retain the basket pin [50] there is also a retaining pin [60].

Conversely, if there is no operator basket [42] attached, a counter weight can be attached to supply the necessary weight to counterbalance the attachment on the end of the variable truss [35]. The operator basket [42] can be attached via solid mount or via bearing [55] which enables the operator basket [42] to self-level. Also, the same user can operate the apparatus remotely via control center which would be parked outside of the water tank or area being media blasted. The control center would have the remote control box used to control the apparatus as well as monitors to supply access to the cameras mounted on the end of the variable length truss [35] as well as onboard diagnostics equipment which would enable real time monitoring of the apparatus during use. The cameras also have night vision capability, enabling the system to be used in environments in which there is little to no light.

The surface media blaster [24] is connected to the variable length truss [35] via two side to side adjusting rams [58] which enables the user to move the surface media blaster [24] from side to side during use. This increases the useable range of the surface media blaster [24] in case the variable length truss [35] has been rotated to an extreme position. The surface media blaster [24] also can be mounted directly to the variable length truss [35] if desired for applications in which space is a premium and the shortest possible profile is required.

Figure 5B:
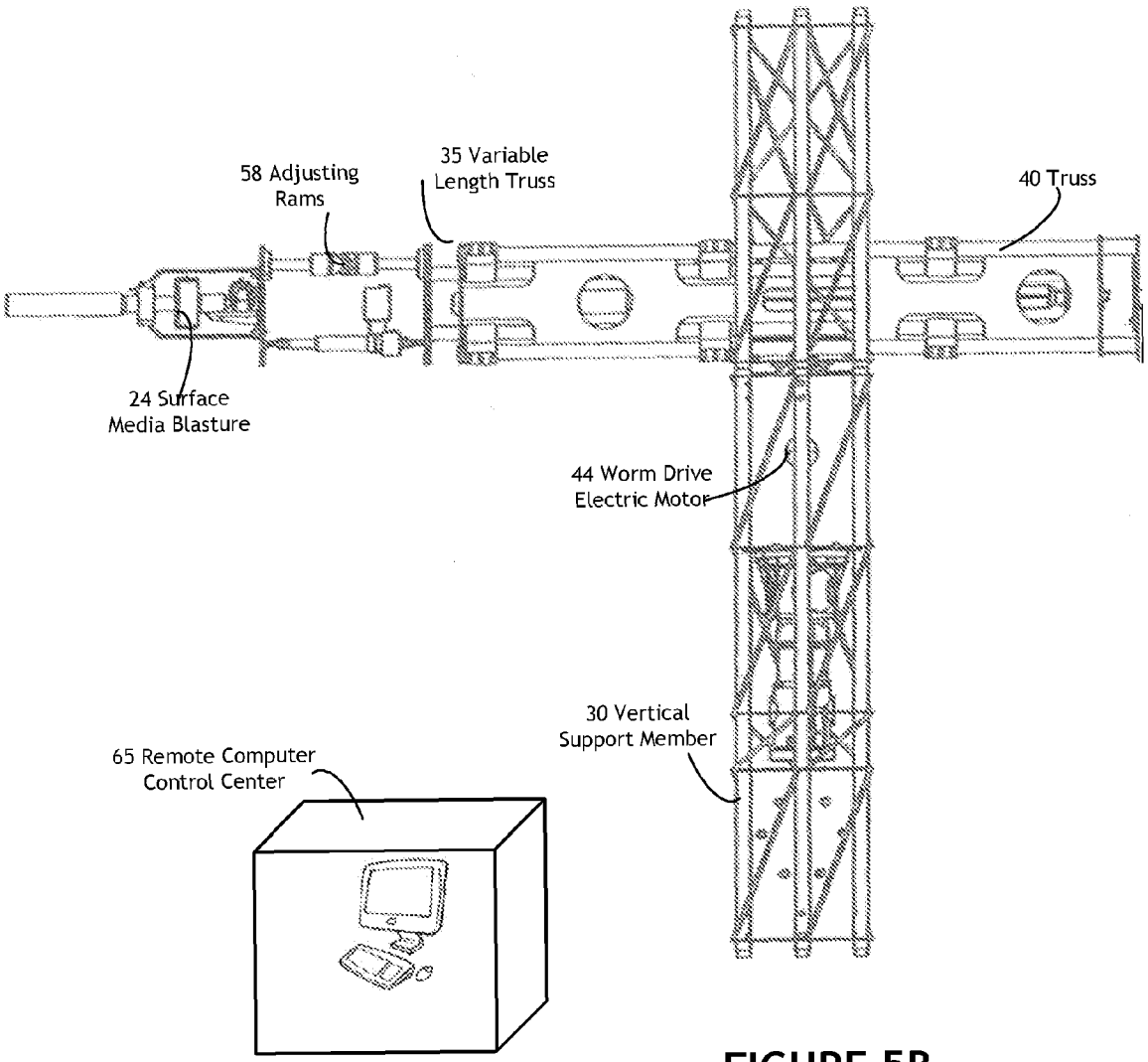
FIG. 5B depicts a side view of yet another preferred embodiment of the surface media blaster of the present invention with a remote computer control center for an operator to control the surface blasting remotely.

FIG. 5B depicts a side view of yet another preferred embodiment of the surface media blaster of the present invention with a remote computer control center [65] for an operator to control the surface blasting remotely.

Figure 6:
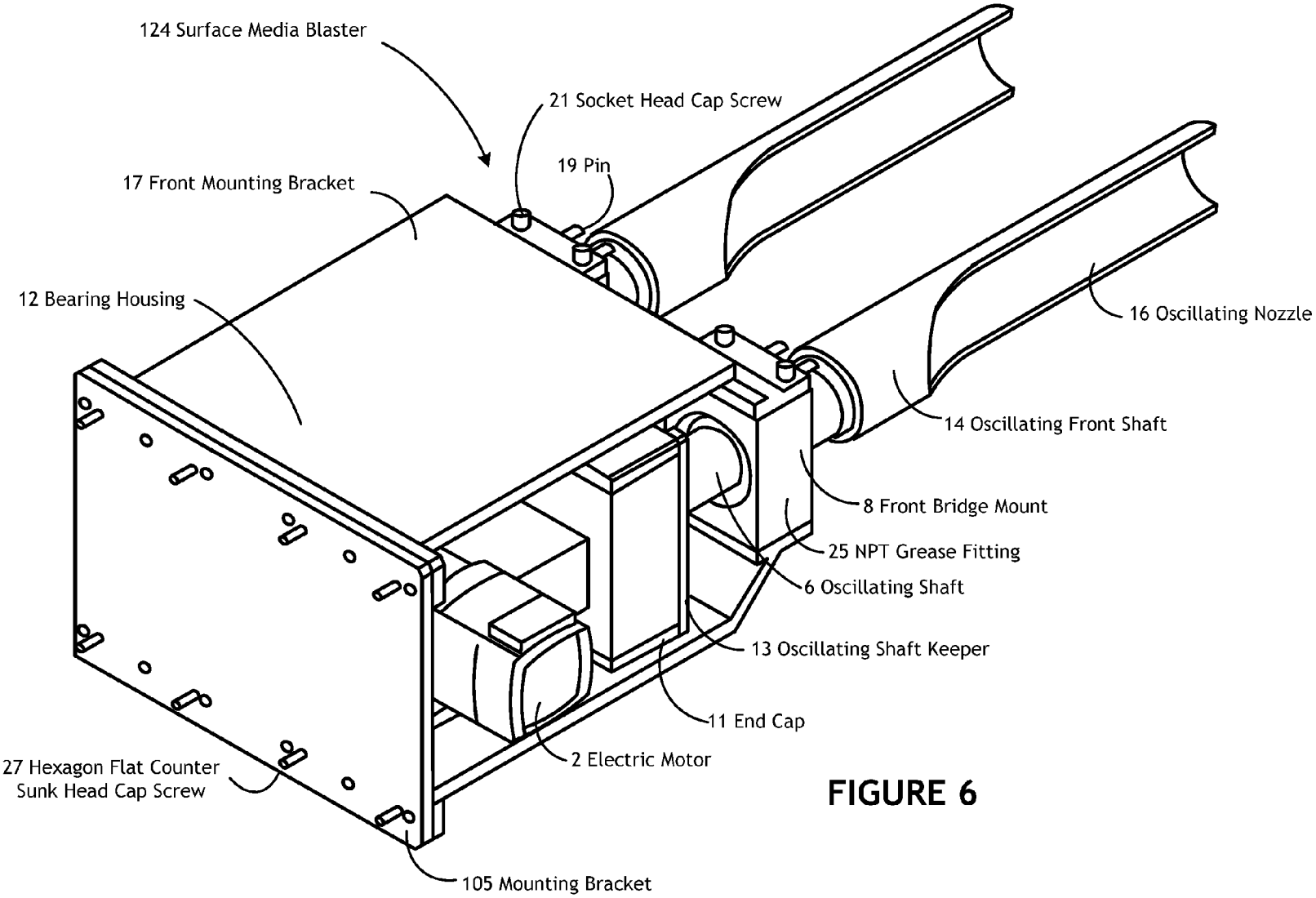
FIG. 6 depicts an assembly view of yet still another preferred embodiment of the surface media blaster of the present invention, whereby a pair of oscillating nozzles are secured onto the same mounting bracket and driven by the same power source.

FIG. 6 depicts an assembly view of yet still another preferred embodiment of the surface media blaster of the present invention [124], whereby a pair of oscillating nozzles are secured onto the same mounting bracket [105]. The use of multiple oscillating nozzles of the present invention [16] enables an operator to design the surface media blaster of the present invention to match the geometry of the surface area being blasted.

Figure 7:
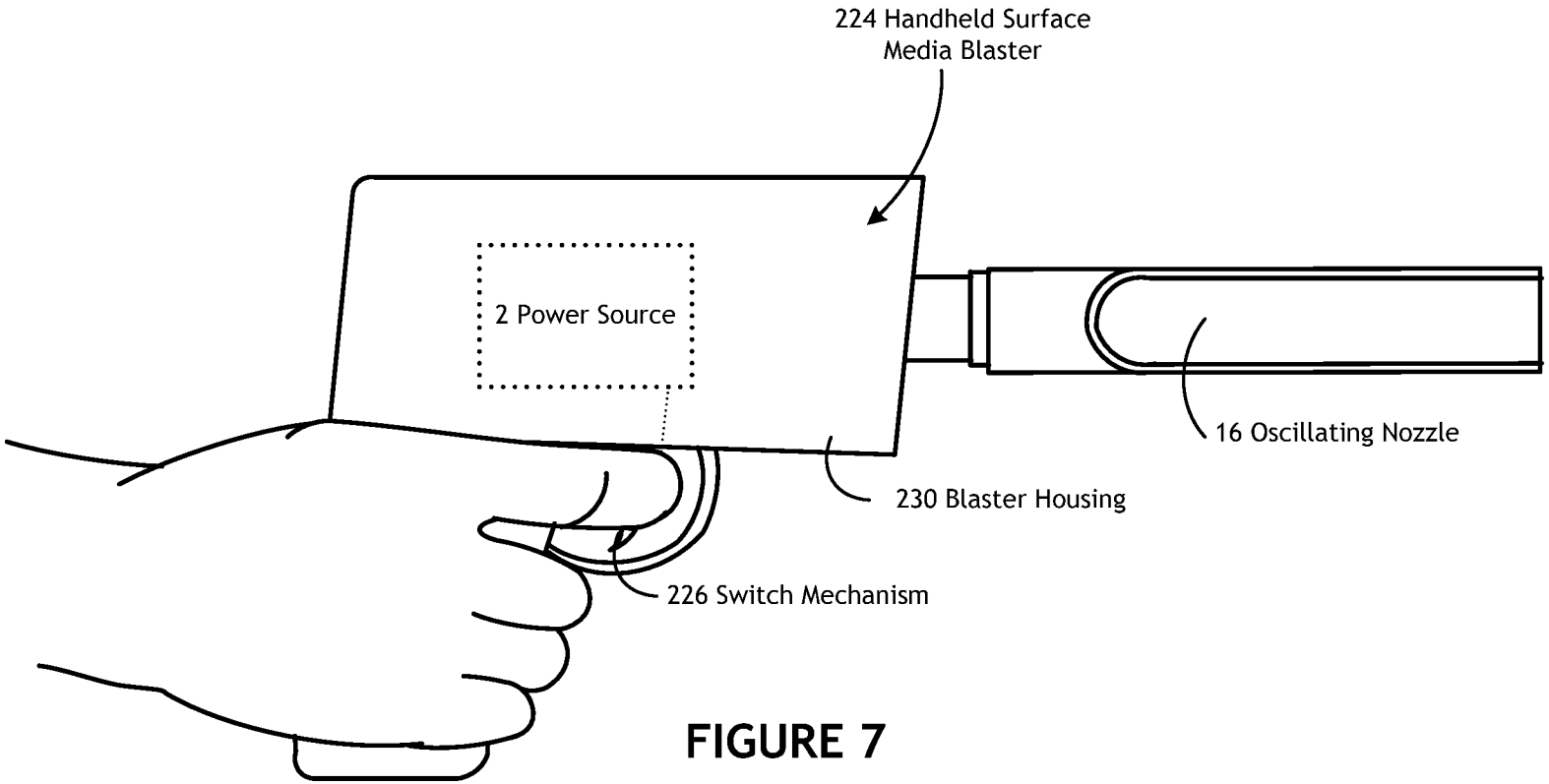
FIG. 7 depicts but still another preferred embodiment of the surface media blaster of the present invention, the surface media blaster being handheld and the power source being engaged by a trigger mechanism much like a trigger on a firearm.

FIG. 7 depicts but still another preferred embodiment of the surface media blaster of the present invention [224]. The surface media blaster [224] is handheld and the power source [2] is engaged by a switch mechanism disposed external to a blaster housing [230]. The switch mechanism is electrically engaged with the power source. The switch mechanism enables an operator to engage and disengage the power source while holding the apparatus in a hand. Preferably the switch mechanism is a trigger mechanism [226] much like a trigger on a firearm.

The surface media blaster [224] is portable, and comprises a nozzle [16] that oscillates, a power source [2], and a switch mechanism [226].

The power source [2] enables the nozzle [16] to oscillate. The media to be blasted is sprayed through the nozzle onto the surface. The nozzle [16] when oscillating projects an enlarged dispersion pattern of the blasting media onto the surface to be blasted.

Increasing the rotational speed of the oscillating nozzle [16] widens the dispersion pattern of the blasting media onto the surface. Decreasing the rotational speed of the oscillating nozzle [16] narrows the dispersion pattern of the blasting media onto the surface.

The trigger mechanism [226] engages the power source [2], the trigger mechanism being engageable by an operator holding the apparatus and pulling the trigger mechanism [226] much like a trigger on a firearm.

The handheld surface media blaster [224] is similar in design to the surface media blaster [24] depicted in FIGS. 2A, 2B, and 2C, except that the power source is engaged and disengaged by the switch mechanism [226] external to the surface media blaster [224].

There is no blasting media passing through the handheld surface media blaster [224] itself, so there is none of the associated wear and tear on the components as is common in other designs in which the media passes through the apparatus, wearing out bearings, motors and requiring frequent rebuilding of the blasting guns.

The surface media blaster apparatus of the present invention is smaller and lighter than previous versions, and thus easier to assemble and disassemble, while being equally as effective. In order to assemble the apparatus, a crane, which is mounted to the top of the water tower, lifts the individual components and lowers them into the tank to be assembled by the users.

In addition to being mounted to a variable length truss, the surface media blaster [24] can also be mounted to a robot arm and controlled remotely, or pre-programmed to operate within a given tank environment.

The surface media blaster [24] can have a quick-detach mechanism, enabling the oscillating head to be changed with one of a different profile which will change the dispersion pattern of the surface media. The quick attach/detach component can be a quick-coupler as made by Saflok®, which is a registered trademark of the Wat International Corp. or via proprietary quick-coupler which uses a twisting motion to lock the oscillating head in place.

Assembly and disassembly is easy and can be done quickly by a few people in a short span of time with the apparatus being modular in construction and using grade 8 bolts for strength and safety. If necessary, more sections may be added to increase the height and width to accommodate different applications where a larger or smaller size may be needed. All hardware is grade 8 or better to ensure strength and safety for the operator and reliability of the apparatus.

Further, all of the necessary control unit wiring is quick disconnect, weather proof, and clearly labeled for ease of use.

Throughout this application, various Patents and Applications are referenced by number and inventor. The disclosures of these documents in their entireties are hereby incorporated by reference into this specification in order to more fully describe the state of the art to which this invention pertains.

It is evident that many alternatives, modifications, and variations of the present invention will be apparent to those skilled in the art in light of the disclosure herein. For example, the system can be used for cleaning all kinds of chemical storage tanks, petroleum tanks, ship hulls, and large piping systems. It is intended that the metes and bounds of the present invention be determined by the appended claims rather than by the language of the above specification, and that all such alternatives, modifications, and variations which form a conjointly cooperative equivalent are intended to be included within the spirit and scope of these claims.

PARTS LIST

1. Ball Joint Swivel Bearing
2. Electric Motor
3. External Retaining Pin
4. Retaining Pin
5. Mounting Bracket—1st Embodiment
6. Oscillating Shaft
7. Internal Retaining Pin
8. Oscillating Front Bridge Mount
9. Flanged, Double Sealed Ball Bearing
10. Double Sealed Ball Bearing
11. End Cap
12. Bearing Housing
13. Oscillating Keepers
14. Oscillating Front Shaft
15. External Retaining Ring
16. Oscillating Nozzle
17. Front Mounting Bracket
18. Hexagon Socket Set Screw
19. Pin
20. Oscillating Slide
21. Hexagon Socket Head Cap Screw
22. Socket Head Cap Screw
23. Bearing
24. Surface Media Blaster—1st Embodiment
25. NPT Grease Fitting
26. Hexagon Pipe Plug
27. Hexagon Flat Counter Sunk Head Cap Screw
29. Spacer
30. Vertical Support Member
32. Horizontal Support Member
35. Variable Length Truss
38. Extension Ram
40. Truss
42. Basket
44. Worm Drive Electric Motors
48. Self-Leveling Frame
50. Basket Pin
55. Bearing
58. Side to Side Adjusting Rams
60. Retaining Pin
65. Remote Computer Control Center
82. Horizontal Axis
84. Vertical Axis
105. Mounting Bracket
124. Surface Media Blaster—2nd Embodiment
224. Surface Media Blaster—3rd Embodiment
226. Switch Mechanism
230. Blaster Housing
232. Line

The invention claimed is:

1. An apparatus for blasting a media onto a surface, said apparatus being attachable onto a variable length truss, said apparatus comprising;

a. a nozzle that is oscillatable;

b. a mount for attaching said nozzle to tooling, said mount enabling said nozzle to be raised and lowered about a vertical axis, said mount enabling said nozzle to be repositioned about a horizontal axis; and c. a power source for enabling said nozzle to oscillate, said media to be blasted being sprayed through said oscillatable nozzle onto said surface, said nozzle when oscillating projecting an enlarged dispersion pattern of said blasting media onto said surface; wherein there is no media passing through said media blasting apparatus.

2. The media blasting apparatus of claim 1, further comprising a basket positioned on an opposing end of said variable length truss, enabling an operator to be positioned and control said blasting of said media onto said surface, said basket being mounted in either a fixed position, or mounted via a swivel bearing, enabling said basket to self-level.

3. The media blaster apparatus of claim 1, further comprising a remote control computer enabling an operator to be positioned remotely from said surface media blaster while controlling said remote control computer said blasting of said media onto said surface.

4. The media blasting apparatus of claim 1, wherein increasing rotational speed of said nozzle when oscillating widens said dispersion pattern of said blasting media onto said surface.

5. The media blaster apparatus of claim 1, wherein said surface media blaster is attached to said variable length truss via a side to side adjusting ram.

6. The media blaster apparatus of claim 2, further comprising means enabling said basket to be readily removed for assembly and disassembly and transport.

7. The media blasting apparatus of claim 3, further comprising a camera mounted on said variable length truss, said camera enabling real time monitoring of said media blasting apparatus during use from said remote control computer.

8. An apparatus for blasting a media onto a surface, said apparatus being attachable onto a variable length truss, said apparatus comprising;

a. a plurality of nozzles that are oscillatable;

b. a mount for attaching said plurality of nozzles to tooling, said mount enabling said plurality of nozzles to be raised and lowered about a vertical axis, said mount enabling said plurality of nozzles to be repositioned about a horizontal axis; and c. a power source for enabling said plurality of nozzles to oscillate, said media to be blasted being sprayed through said plurality of nozzles onto said surface, said plurality of oscillatable nozzles when oscillating projecting an enlarged dispersion pattern of said blasting media onto said surface; wherein there is no media passing through said media blasting apparatus.

9. The media blasting apparatus of claim 8, further comprising a basket positioned on an opposing end of said variable length truss, enabling an operator to be positioned and control said blasting of said media onto said surface, said basket being mounted in either a fixed position, or mounted via a swivel bearing, enabling said basket to self-level.

10. The media blaster apparatus of claim 8, further comprising a remote control computer enabling an operator to be positioned remotely from said surface media blaster while controlling said remote control computer said blasting of said media onto said surface.

11. The media blasting apparatus of claim 8, further comprising a mounting bracket supporting said plurality of oscillatable nozzles.

12. The media blasting apparatus of claim 8, wherein increasing rotational speed of said oscillatable nozzle widens said dispersion pattern of said blasting media onto said surface.

13. The media blaster apparatus of claim 8, wherein said surface media blaster is attached to said variable length truss via a side to side adjusting ram.

14. The media blasting apparatus of claim 1, wherein the media to be blasted is supplied to the media blasting apparatus via a line attaching to the media blasting apparatus.

15. The media blasting apparatus of claim 1, wherein decreasing rotational speed of said oscillatable nozzle narrows said dispersion pattern of said blasting media onto said surface.

16. The media blasting apparatus of claim 8, wherein the media to be blasted is supplied to the media blasting apparatus via a line attaching to the media blasting apparatus.

17. The media blasting apparatus of claim 8, wherein decreasing rotational speed of said oscillatable nozzle narrows said dispersion pattern of said blasting media onto said surface.

18. The media blasting apparatus of claim 10, further comprising a camera mounted on said variable length truss, said camera enabling real time monitoring of said media blasting apparatus during use from said remote control computer.

* * * * *